US006308802B1

(12) United States Patent
Briere

(10) Patent No.: US 6,308,802 B1
(45) Date of Patent: Oct. 30, 2001

(54) MOBILE ELEVATOR ASSEMBLY

(76) Inventor: Michel Briere, 205 Houde, Laprairie, Quebec (CA), J5R 3B4

( * ) Notice: Subject to any disclaimer, the term of this patent is extended or adjusted under 35 U.S.C. 154(b) by 0 days.

(21) Appl. No.: 09/640,931

(22) Filed: Aug. 17, 2000

(51) Int. Cl.[7] ..... B66B 9/16
(52) U.S. Cl. ..... 187/243; 187/242
(58) Field of Search ..... 187/242, 243, 187/244, 240; 182/69.4; 52/118, 119, 120

(56) References Cited

U.S. PATENT DOCUMENTS

| | | | | |
|---|---|---|---|---|
| 470,112 | * | 3/1892 | Ehrentraut | 187/242 |
| 815,594 | * | 3/1906 | Kovacevic | 187/242 |
| 3,101,816 | * | 8/1963 | Fox | 52/118 |
| 3,937,301 | * | 2/1976 | Bertail | 187/243 |
| 4,134,237 | * | 1/1979 | Armstrong | 52/118 |
| 4,491,196 | * | 1/1985 | Bocker | 187/243 |

FOREIGN PATENT DOCUMENTS

| | | | | |
|---|---|---|---|---|
| 2587399 | * | 12/1987 | (FR) | 52/118 |
| 401203200 | * | 8/1989 | (JP) | 187/243 |
| 000048465 | * | 10/1964 | (PL) | 187/242 |

* cited by examiner

*Primary Examiner*—Robert P. Olszewski
*Assistant Examiner*—Steven B. McAllister
(74) *Attorney, Agent, or Firm*—Eric Fincham

(57) ABSTRACT

A mobile elevator assembly which may be used for gaining access to balconies and the like for purposes of moving furniture further comprises a trailer base upon which all components are mounted, a plurality of telescoping frame assemblies which can be raised from a first nested position to an erect position on the base, a vertically extending track member which is secured to the erected frame assemblies, a carriage moveable along the track member, and a winch and cable for raising and lowering the carriage.

7 Claims, 6 Drawing Sheets

MOBILE ELEVATOR ASSEMBLY

FIELD OF THE INVENTION

The present invention relates to an elevator type device and more particularly, relates to a mobile elevator assembly.

BACKGROUND OF THE INVENTION

There are numerous occasions wherein it is required that one gain access to an elevated location such as for purposes of repair. There are many different types of apparatuses which can be used for such purposes and one common type of apparatus is a moveable platform such as may be used in repairing electrical or telephone cables or the like.

For the consumer, one occasion where a mobile elevator assembly would be desirable is when it becomes time to move furniture or appliances from an upper story. This upper story may either be in a house or in an apartment building. Frequently, one has to move relatively heavy objects down staircases with limited room for maneuverability.

SUMMARY OF THE INVENTION

It is an object of the present invention to provide a mobile elevator assembly which permits one to gain access to elevated locations and which is transportable.

According to one aspect of the present invention, there is provided a mobile elevator assembly comprising a base, a plurality of telescoping frame assemblies, means for raising and lowering the telescoping frame assemblies from a first nested position to an erect position on the base, means for securing the telescoping frame assemblies together when the telescoping frame assemblies are in an erect position, a vertically extending track member secured to the telescoping frame assemblies to thereby form a substantially continuous track when the telescoping frame assemblies are in an erect position, a carriage moveable along the track member, and lift means for raising and lowering the carriage.

In a greater detail, the mobile elevator assembly of the present invention can be used in a great number of applications. Thus, a primary use would be to gain access to the upper floors of low rise apartment buildings and/or residences. However, it could equally well be used to serve as a temporary replacement for scaffolding, ladders, etc.

As aforementioned, the mobile elevator assembly includes a base. Although a separate base could be provided upon which the frame assemblies are subsequently mounted, a preferred embodiment provides that the mobile elevator assembly is transported on a conventional type of trailer and the trailer serves as the base. To this end, the trailer, when hauled to the site where the mobile elevator assembly is to be used, would require means of stabilizing the same. Conventional stabilizing legs can be used.

The mobile elevator assembly includes a plurality of frame assemblies which are connected one to the other. Any convenient number may be utilized and preferably, the frame assemblies are arranged in a telescoping fashion such that when in a storage position, they nest one within the other and yet can be readily raised to achieve the desired height. Two or more such telescoping frame assemblies are utilized.

Each of the telescoping frame assemblies may be constructed in a conventional manner having both horizontal frame members and vertical frame members with reinforcing members extending between. Any number of such structures are known in the art. Although, the frame assemblies may have any conventional configuration such as a rectangular shape, a preferred embodiment uses triangularly shaped frame sections which provide sufficient structural integrity while minimizing the weight and cost of the structure.

Once erected, the frame assemblies are secured together to form a solid structure. While many means for securing members together are known in the art including various types of clamp structures, etc, a convenient means may include a connecting member mating with like members on vertical frame members of the respective frame assemblies.

In order to erect the frame assemblies, there may be provided a gin pole which is also mounted on the base and which with a suitable winch and cable arrangement, either driven manually or electrically, can be utilized to raise the telescoping frame assemblies. One particular embodiment will be described in the preferred embodiments of the invention.

There is provided at least one vertically extending track member which is secured to the telescoping frame assemblies when they are in an erect condition. The track member is that in which the carriage will ride along. Although a single track member may be employed, in a preferred embodiment, a pair of such track members are utilized.

The carriage which is moveable along the track member or members may assume many different forms. Thus, it could comprise a platform upon which a person can stand. Alternatively, it may comprise a fork member similar to that used in lift fork trucks. It suffices to say that many different types of carriages can be employed with the present invention.

In order to raise the carriage member, suitable lift means are provided. Again, it is well known in the art to use different types of lift mechanisms including hydraulic, electrical and/or manual. It again suffices to say that any conventional lift means may be utilized.

In one embodiment of the invention, there are provided telescoping rails which may be used in conjunction with the carriage assembly. This arrangement can be particularly useful when it is desired to load or unload furniture or other goods from a balcony. In such an instance, the carriage moves above the balcony and the telescoping rails will then extend down to the balcony and a suitable transporting member may ride along the rails.

BRIEF DESCRIPTION OF THE DRAWINGS

Figure 1:
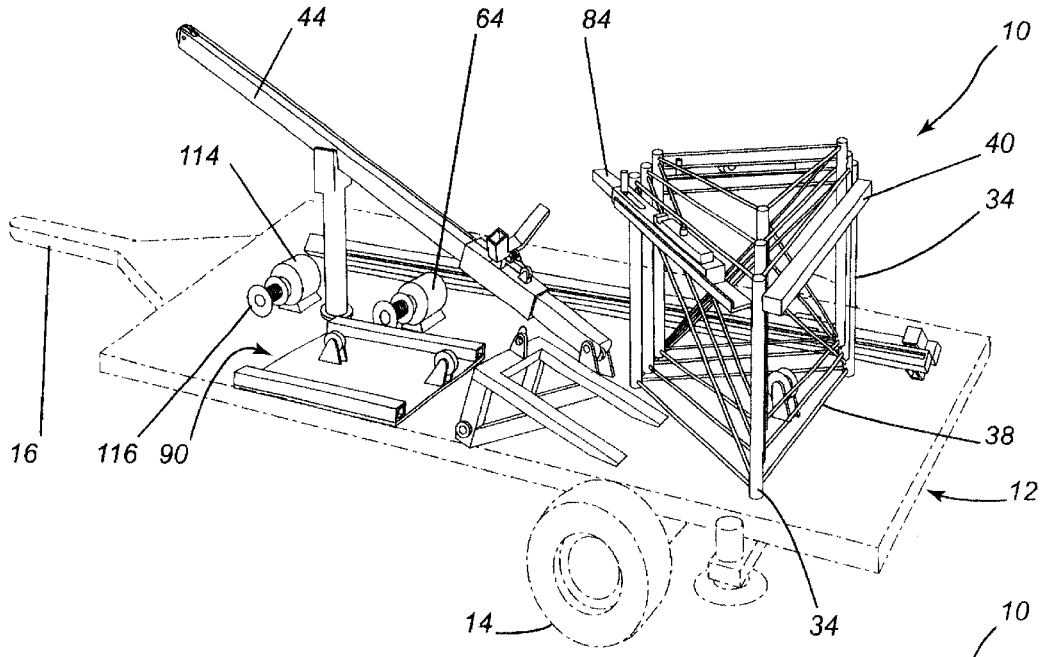
Figure 2:
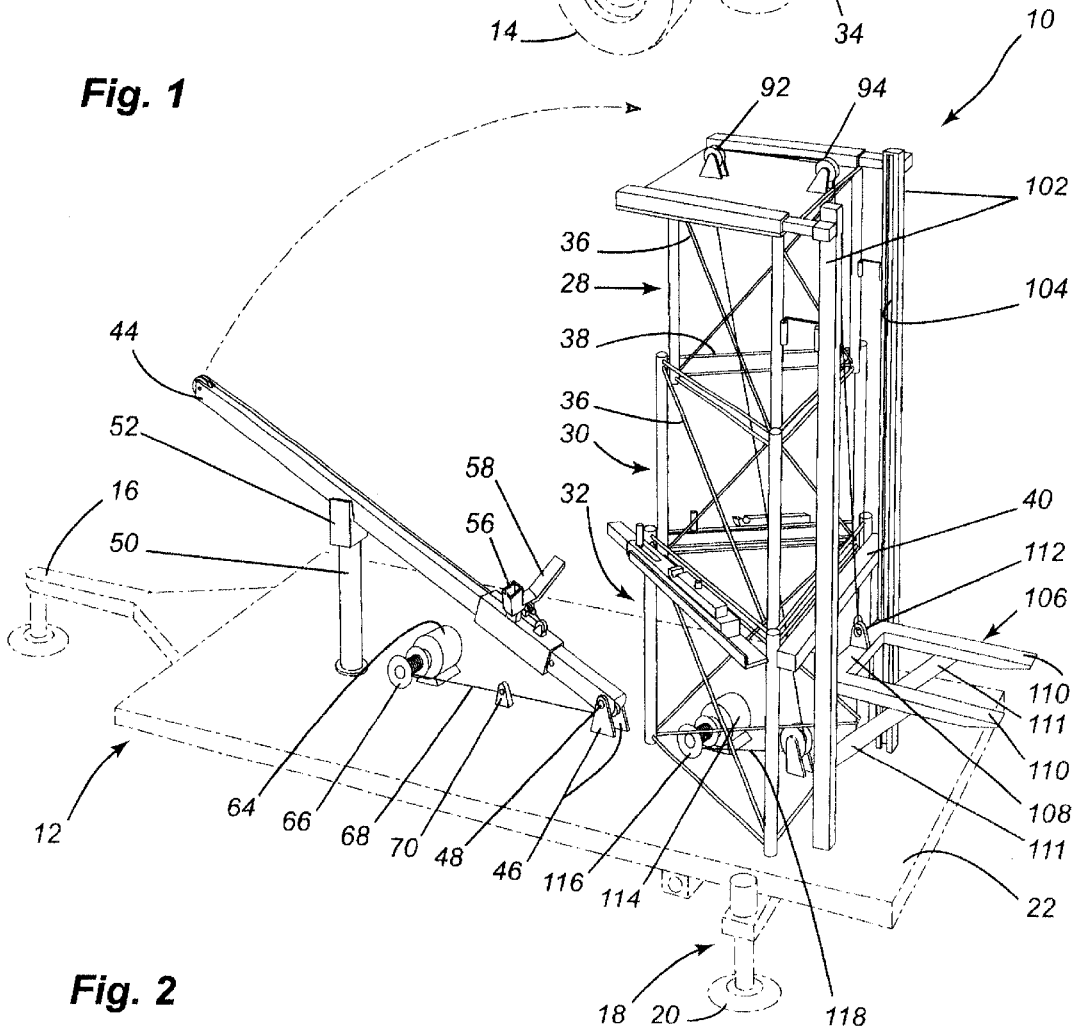
Figure 3:
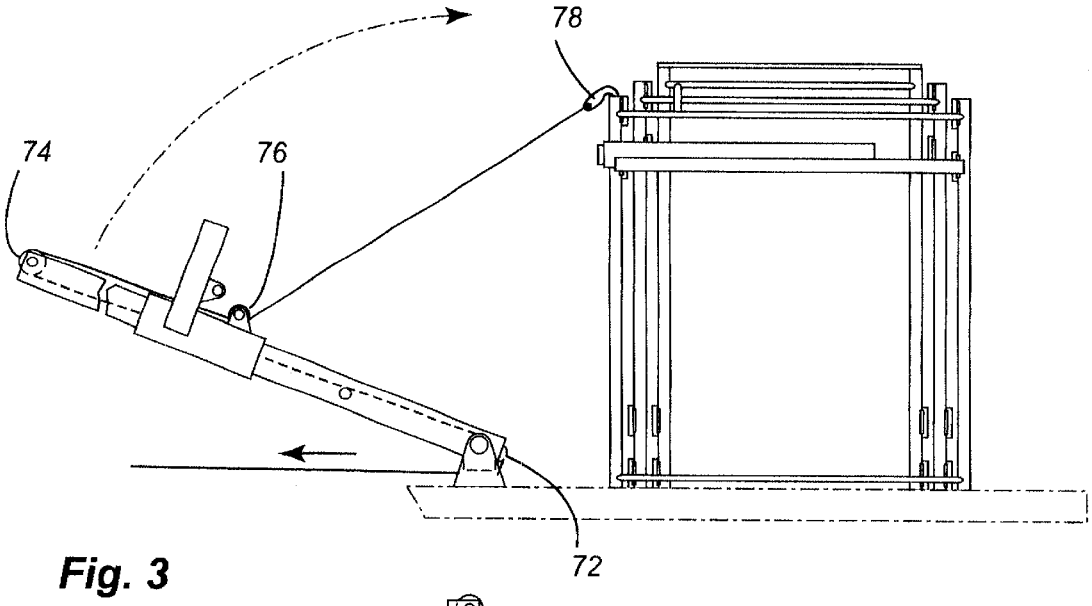
Figure 4:
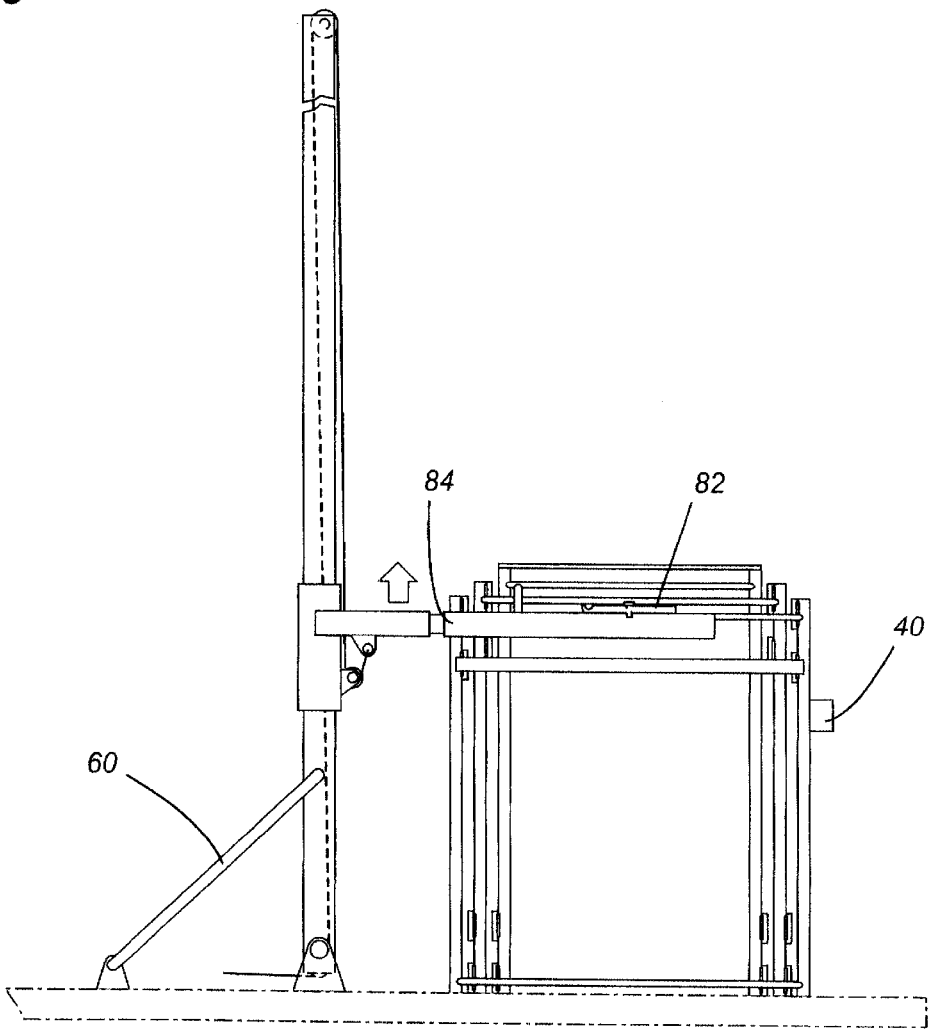
Figure 5:
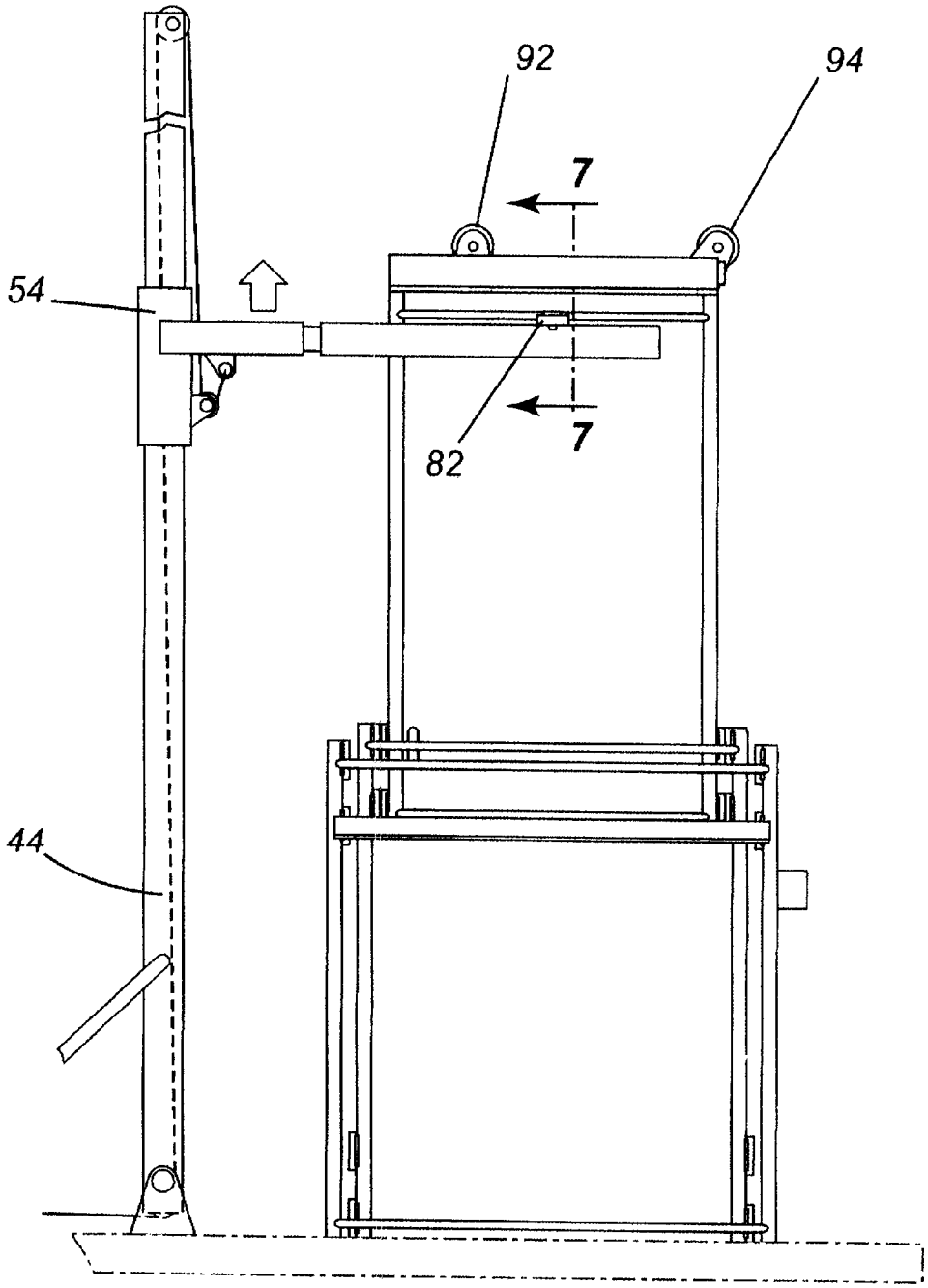
Figure 6:
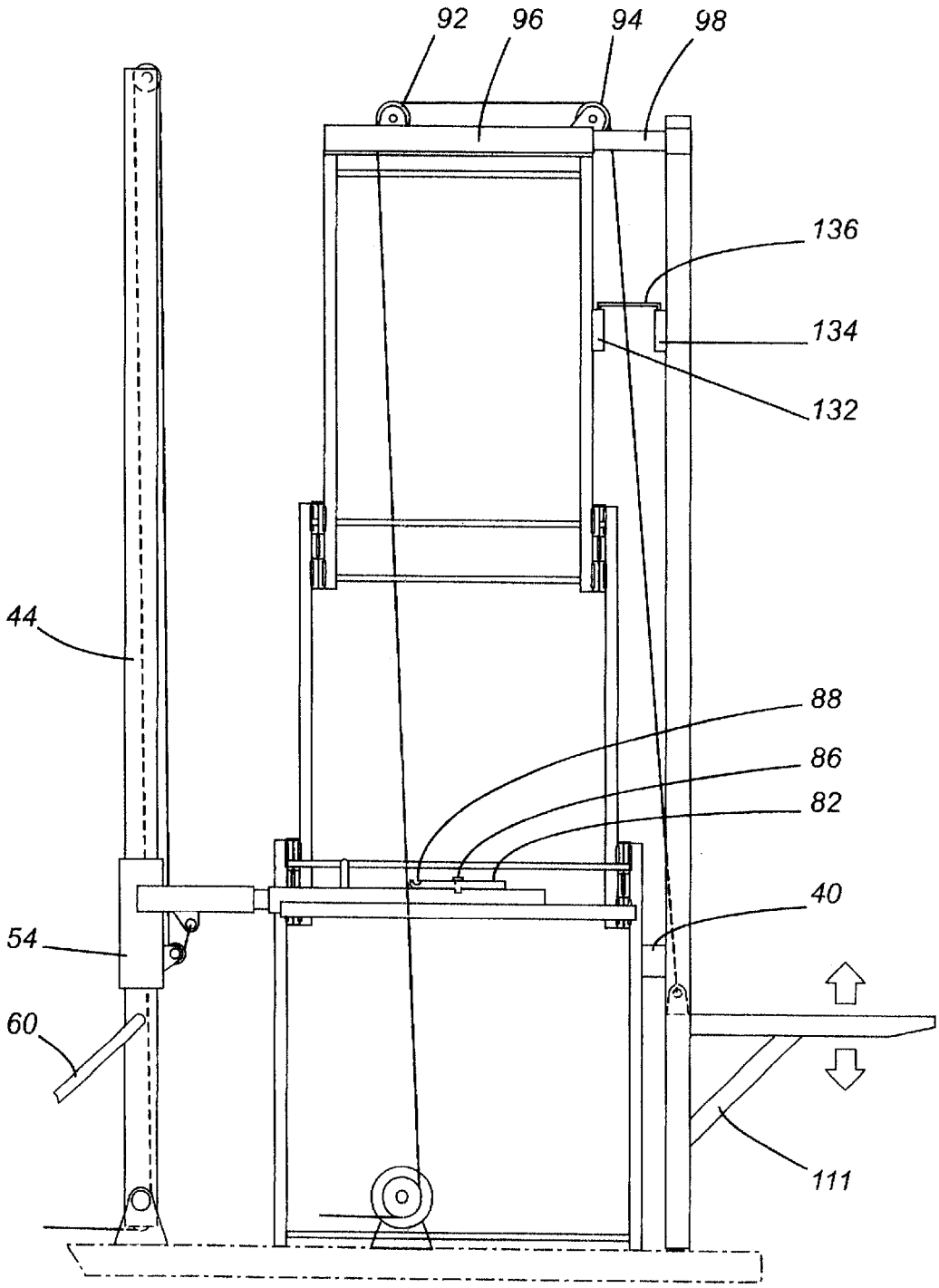
Figure 7:
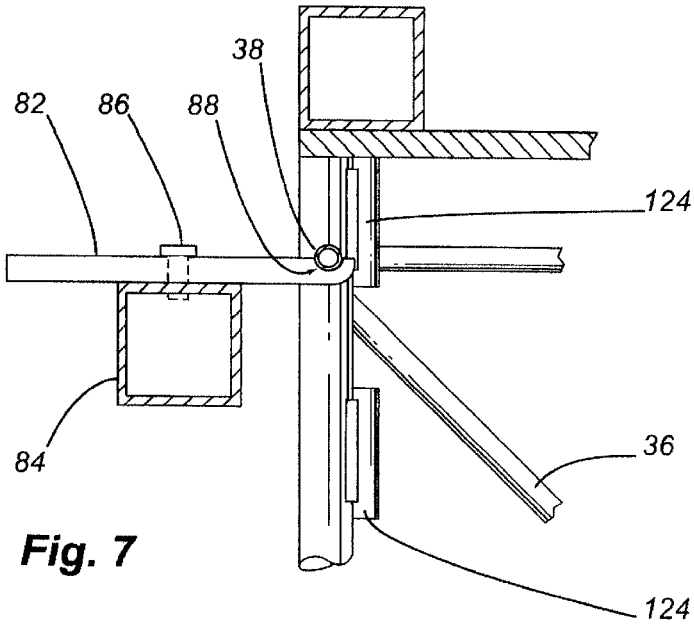
Figure 8:
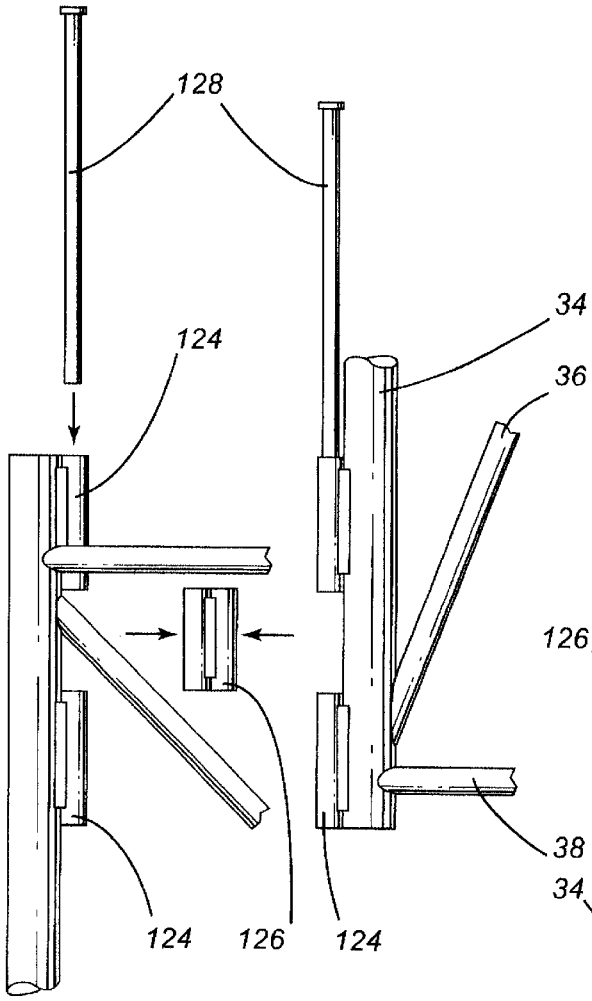
Figure 9:
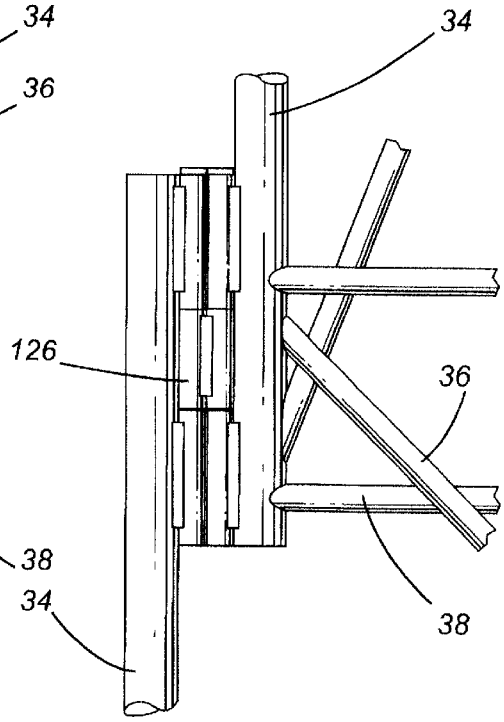

Having thus described the invention, reference will be made to the accompanying drawings illustrating embodiments thereof, in which:

FIG. 1 is a perspective view of a mobile elevator assembly according to an embodiment of the present invention when in a disassembled condition;

FIG. 2 is a view similar to FIG. 1 illustrating the mobile elevator assembly in an assembled condition with the wheels of the transporting trailer being removed for purposes of clarity;

FIG. 3 is a partial side elevational view illustrating the first step in the erection of the mobile elevator assembly;

FIG. 4 is a view similar to FIG. 3 illustrating the gin pole in an erect position ready to start assembly of the elevator assembly;

FIG. 5 is also a view similar to FIGS. 3 and 4 illustrating the erection of the elevator assembly;

FIG. 6 is a partial side elevational view illustrating the operation of the elevator;

FIG. 7 is a sectional view of the telescoping arm arrangement for erection of the frame assemblies;

FIG. 8 is a partial side elevational view showing the connection of the frame sections;

FIG. 9 illustrates the frame sections when in a connected position; and

Figure 10:
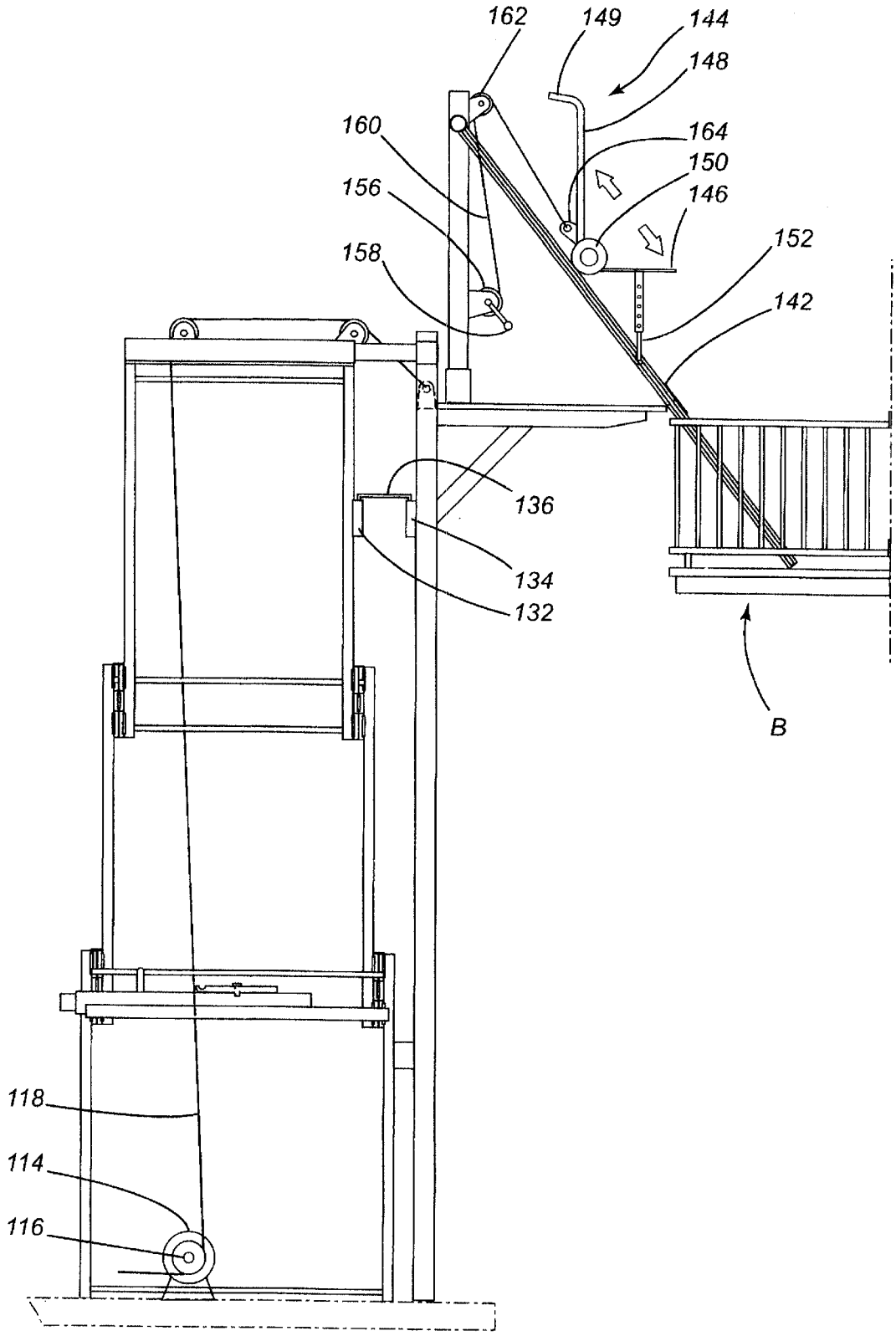

FIG. 10 is a partial side elevational view illustrating operation of the mobile elevator assembly in a manner to permit access to balconies and the like.

DESCRIPTION OF THE PREFERRED EMBODIMENTS

Referring to the drawings in greater detail and by reference characters thereto, there is illustrated in FIG. 1 a mobile elevator assembly when in a disassembled or unerected condition and ready for transport to a site. Mobile elevator assembly, generally designated by reference numeral 10, is mounted on a trailer 12. Trailer 12 has wheels 14 and a trailer hitch 16 for attachment to a vehicle to tow the mobile trailer assembly to the desired site. There are also provided stabilizers 18 on either side of the trailer, each stabilizer having a stabilizer pad 20 designed to contact the ground. The trailer base is generally designated by reference numeral 22.

Mobile elevator assembly 10 includes a plurality of frame sections, with the illustrated embodiment having three such frame sections—an inner frame section generally designated by reference numeral 28, an intermediate frame section generally designated by reference numeral 30 and an outer frame section generally designated by reference numeral 32. Each of the frame sections 28, 30 and 32 are comprised of a plurality of structural members—vertical posts 34, diagonal struts 36 and horizontal members 38. In the illustrated embodiment, frame sections 28, 30 and 32 are triangular in overall configuration and as may be seen in FIG. 1, in an unerected condition, are designed to nest one within the other.

Mobile elevator assembly 10 includes a gin pole 44. On trailer base 22, there are provided a pair of gin pole brackets 46 to which gin pole 44 is mounted by means of gin pole pivot pin 48. There is also provided a gin pole support 50 for supporting gin pole 44 when in an unerected condition and to this end, there is provided a member 52 having a U shaped recess on gin pole support 50.

A slidable member 54 is mounted on gin pole 44 and is slidable along the length thereof. Gin pole slidable member 54 includes a pair of arms 56 and 58 which extend outwardly in a V shaped configuration for reasons which will become apparent hereinbelow.

Mounted on trailer base 22 is a first electric motor 64 having a winch 66 operatively connected thereto and about which is entrained cable 68. A pulley 70 is mounted on trailer base 22 while there is also provided a pulley 72 at the bottom of gin pole 44. At the top of gin pole 44, there is provided a top pulley 74. Gin pole slidable member 54 also has a pulley 76 thereon. At the end of cable 68, there may be provided a detachable hook 78 as shown in FIG. 3 for reasons which will become apparent hereinbelow.

Arm extensions 84 are provided and are designed to fit within arms 56 and 58 of gin pole slidable member 54. In turn, frame engaging members 82 having a recess 88 are pivotably mounted thereon by means of pins 86.

A top platform 90 is adapted to be mounted on the top of inner frame section 28; top platform 90 has a middle pulley 92 and outer pulley 94 mounted thereon. Top platform 90 also includes a pair of parallel side members 96 each having an extendable arm portion 98 associated therewith.

Mobile elevator assembly 10 also includes a pair of elevator track members 102, each having a recess 104 formed in a side thereof and arranged to be facing each other. An elevator carriage in the form of a fork 106 is designed to ride within recesses 104 with a suitable roller member (not shown). Elevator fork 106 is comprised of a base 108 and a pair of outwardly extending fork arms 110 having bracing arms 111. Mounted on elevator fork base 108 is a pulley attachment 112.

Mounted on trailer base 22 underneath frame sections 28, 30 and 32 is an electric motor 114 and associated winch 116 with a cable 118.

In operation, the mobile elevator assembly 10 is towed to a desired site. Subsequently, gin pole 44 is erected from its storage position shown in FIG. 1 to a vertical position as shown in FIG. 4. To this end, cable 68 is entrained about pulleys 70, 72, 74 and 76 (as shown in FIG. 3) and hook 78 is connected to a suitable portion of one of the frame sections 28, 30 and 32. Electric motor 64 and winch 66 are then operated to raise gin pole 44 to the vertical position and a stabilizing leg 60 is then secured thereto.

Subsequently, arm extensions 84 are engaged in arms 56 and 58 and member 82 is pivoted whereby recess 88 engages a horizontal member 38 of inner frame section 28. Cable 68 is then connected to slidable member 54 and used to raise inner frame section 28. At this point, inner frame section is then connected to intermediate frame section 30 as shown in FIGS. 8 and 9 to which reference will now be had.

Each of the vertical posts 34 carry conventional connectors 124 which have a cylindrical aperture formed therein. A middle connector 126 is designed to fit between connectors 124 on two adjacent vertical posts 34 of inner frame section 28 and intermediate frame section 30. Locking pins 128 are then inserted through the apertures in the connectors 124 and 126 to lock the frame sections together as shown in FIG. 9.

Subsequently, the operation is repeated to raise intermediate frame section 30 from its position nesting within outer frame section 32. The intermediate frame section 30 and outer frame section 32 are then attached in the same manner as described above for inner frame section 28 and intermediate frame section 30.

Subsequently, elevator track members 102 are erected and secured to outer horizontal frame member 40 and to extendable arms 98. As shown in FIG. 6, inner frame section 28 and elevator track member 102 each carry connectors 132 and 134 respectively. Connectors 132 and 134 are similar to connectors 124 and a U shaped connector pin 136 is inserted therein to lock elevator track members 102 in place.

Cable 118 is then entrained about pulleys 92 and 94 and connected to pulley attachment 112 of elevator fork 106. Motor 114 may then be operated to raise and to lower elevator fork 106 as desired.

It will be understood that elevator fork 106 may have various attachments and/or configurations. Thus, it may not be a fork member but may be a solid platform if so desired.

Referring to FIG. 10, there is shown a variation of the above. In this arrangement, there is provided a pair of telescoping rails 142 (only one shown) with a transporting member 144. Transporting member 144 is comprised of a base 146, and a back 148 which merges with a handle section 149. Wheels 150 are designed to ride on telescoping rails 142 while there is provided guide members 152 which ride within telescoping rails 142 and which guide members 152 are adjustable in length.

There is also provided a hand operated winch 156 with handle 158 mounted on a vertical post 154 secured to elevator fork 106. A cable 160 is entrained about an upper pulley 162 and connected to bracket 164 on transporting member 144.

As may be seen, in this embodiment, telescoping rails 142 may be used to have access to a balcony B for moving certain items.

It will be understood that the above described embodiments are for purposes of illustration only and that changes and modifications may be made thereto without departing from the spirit and scope of the invention.

I claim:

1. A mobile elevator assembly comprising:

a base;

a plurality of telescoping frame assemblies;

means for raising and lowering said telescoping frame assemblies from a first nested position to an erect position on said base;

means for securing said telescoping frame assemblies together when said telescoping frame assemblies are in an erect position;

a vertically extending track member secured to said telescoping frame assemblies to thereby form a substantially continuous track when said telescoping frame assemblies are in an erect position;

a carriage moveable along said track member; and lift means for raising and lowering said carriage.

2. The mobile elevator assembly of claim 1 wherein said base comprises a wheeled trailer.

3. The mobile elevator assembly of claim 2 further including ground contacting stabilizing members on said wheeled trailer.

4. The mobile elevator assembly of claim 1 wherein said telescoping frame assemblies are triangular in configuration.

5. The mobile elevator assembly of claim 1 further including a gin pole hingedly connected to said base.

6. The mobile elevator assembly of claim 5 wherein said gin pole includes a member slidable therealong, said member being arranged to engage an upper end of an innermost one of said telescoping frame assemblies when said gin pole is in an upright position, and drive means for moving said member vertically along said gin pole to thereby erect said telescoping frame assemblies.

7. The mobile elevator assembly of claim 6 wherein said drive means comprises a winch and cable.

* * * * *